United States Patent [19]

Klemm

[11] 4,249,688

[45] Feb. 10, 1981

[54] DEVICE FOR INTERMITTENT FEEDING OF WEBS

[76] Inventor: Gerhard Klemm, Am Rehwinkel 37, 4800 Bielefeld 1, Fed. Rep. of Germany

[21] Appl. No.: 21,819

[22] Filed: Mar. 19, 1979

[30] Foreign Application Priority Data

Mar. 20, 1978 [DE] Fed. Rep. of Germany ..... 2812099

[51] Int. Cl.[3] ..... B65H 25/24; B65H 17/28

[52] U.S. Cl. ..... 226/24; 226/30; 226/95

[58] Field of Search ..... 226/24–30, 226/31, 95, 97, 120, 122, 123; 242/182, 206, 208

[56] References Cited

U.S. PATENT DOCUMENTS 3,499,614 3/1970 Badum ..... 226/95

*Primary Examiner*—Leonard D. Christian

*Attorney, Agent, or Firm*—Michael J. Striker

[57] ABSTRACT

The transport device for intermittently feeding a web into or from a printing machine, for example, includes a rotary hollow cylinder having a perforated cylindrical wall for supporting the web, a stationary suction segment arranged in the cylinder in contact with the portion of the inner cylindrical surface that is below the web, and a main drive adapted for imparting an intermittent rotation to the cylinder, and a correction drive coupled to electronic registration detector to impart an additional adjustment to the forward drive in one feeding interval.

18 Claims, 8 Drawing Figures

DEVICE FOR INTERMITTENT FEEDING OF WEBS

BAKCKGROUND OF THE INVENTION

This invention relates generally to transport devices, and more specifically it relates to a device for intermittent feeding of webs, the device including a driven transport cylinder arranged in operative proximity to the inlet or the outlet of a printing machine, for supporting the web to be fed into or out of the machine.

Various devices for intermittent feeding of webs, particularly flexible webs, are known from the prior art. The most commonly used types employ tongues or holders arranged laterally of the web and are operable to laterally seize the web and forward the same for a certain feeding distance into the printing machine. Thereupon the transport device runs against a limit switch which opens the tongues and actuates the device to return to its original position, to seize the web again and to repeat the forwarding movement. The disadvantage of such a prior-art transport device is the fact that the web is subject to excessive pulling forces.

It is also known from the German publication No. 23 32 153 for example, to employ continuously rotating vacuum rollers through which the web is forwarded by means of vacuum and uniformly discharged from the printing machine. These known vacuum rollers, however, are applicable for continuous forward feeding only, but are suitable for an intermittent transport.

SUMMARY OF THE INVENTION

It is, therefore, a general object of the present invention to overcome the aforementioned disadvantages.

More particularly, it is an object of the invention to provide an improved transport device which possesses the advantages of the vacuum rollers but which is suitable for an intermittent feeding of the web.

Another object of this invention is to provide such an improved intermittent transport device which enables exact registering and guiding of the web.

In keeping with these objects, and others which will become apparent hereafter, one feature of the invention resides, in a transport device for intermittently feeding a web, in the provision of a rotary hollow cylinder having a perforated cylindrical wall for supporting the web, a stationary suction member arranged in the cylinder in operative proximity to a portion of the inner surface of the cylindrical wall which is covered by the web, and a driving device for imparting an intermittent rotation to the cylinder so that the web which is compressed against the cylindrical surface by the suction acting through the perforations in the wall, is taken along by the intermittently rotating cylinder. The length of advance of the web is determined by the angular displacement of the transport cylinder which in turn is controlled by the reciprocating drive. The suction segment within the transport cylinder remains immobile during the rotation of the cylinder.

The determination of the amount of the intermittent rotary movement of the cylinder and thus of the intermittent forward travel of the web, can be exactly adjusted in all sections of the path of travel of the web. The essential advantage of the device of this invention is in the fact that the upper surface of the web remains completely free during the transport. Consequently, it is no longer necessary to provide for free lateral edges having holding regions which remain unprinted, as is the case in conventional devices employing tongues where a counter-pressure is to be exerted against the tongues. In the device of this invention, the newly printed web is held by the suction effect from below and forwarded intermittently by the transport cylinder in exactly defined steps. Another advantage of this invention is to be seen in the absence of any slippage between the cylinder and the web; the vacuum generated by the suction member seizes the web over its entire width. As a result, an exact intermittent forward pulling of the web is attainable and an increased accuracy of register in the printing area is insured.

Furthermore, there is a possibility to construct the driving means for the transport cylinder in two stages each rotating the cylinder in a different phase of its angular displacement. This two-stage drive can be achieved by the provision of an additional drive but also by employing a master drive which can operate in two different driving phases. The driving means for the transport cylinder is preferably a digitally controlled electromotor. In this manner, the web is normally advanced in the first transporting phase and then is adjusted in a correcting phase. The correction feeding is controlled via a control mechanism cooperating with a registering device which reads register marks and the like on the web. Due to this further elaboration of the inventive idea it is possible to refeed the web several times through the printing machine. In doing so it has to be taken into account that when printing a paper web, for example, the moisture of the link applied on the web causes an extension of the paper which changes the length of the feeding intervals.

The feeding intervals of the web are adjusted either purely mechanically or by means of a digitally controlled driving motor whereby the main drive of the cylinder is accurate only during the first feeding of the web through the printing machine. If the web passes through the printing machine for the second printing, the extension or elongation of the web produced by the first printing cannot be compensated by the uniform intermittent rotary movement of the feeding cylinder of the transporting device. For this reason, according to another feature of this invention, during each repeated feeding of the web, the angular displacement of the transport cylinder is adjusted to be a little smaller than that during the first feeding and the difference of the advancing interval is compensated by a second drive designated as a correction drive which includes a driving motor cooperating with a control device and with a registering device. The second drive employs preferably a reduction gear. The main drive of the transport cylinder rotates the latter about a substantial interval of the feeding interval of the web whereby the corrective or second driving motor which performs the second phase of the intermittent advance is activated upon completion of the first phase so that the transport cylinder continues its rotation and slowly takes along the web until the registering device reads a register mark or the like index point and switches off via the control device of the second driving motor. At this moment the forwarding step is completed and the web can be printed, for example, before a new feeding step takes place.

The register marks can be preferably in the form of punched holes in the web but it is also possible to employ other marks, such as crosses or any line or guide mark applied by means of an auxiliary printer, for example upon the web.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
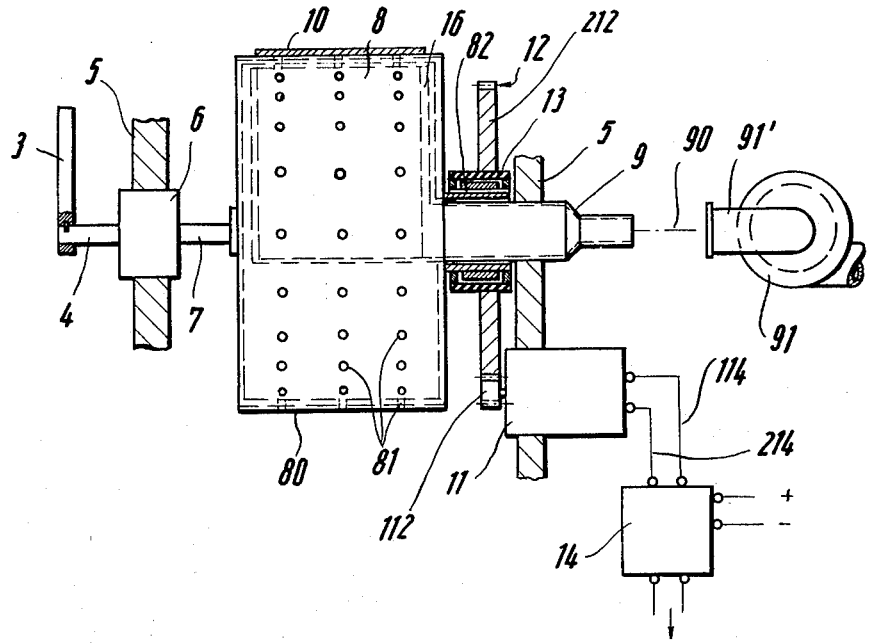
FIG. 1 is a front view partly in section of one embodiment of the transport device of this invention.

In the embodiments as illustrated in FIGS. 1–4, there are provided mechanical means both for the main drive and for the auxiliary or corrective drive of the device of this invention.

The transport device of this invention is designed for intermittently forwarding a web 10 which preferably is a web impenetratable to air but under certain circumstances a web penetratable by air can also be used. The device includes a hollow transport cylinder 8 supported for rotation on a stationary frame 5. The cylindrical outer surface of cylinder 8 is preferably provided with a frictional lining 80 and the hollow cylindrical wall together with the lining define a plurality of perforations or holes 81. A shaft 7 projecting from the center of one base of cylinder 8 is connected to a unidirectional free wheeling coupling 6, whereas the juxtaposed central portion of the other base of cylinder 8 is connected to a tubular sleeve 82 which engages another free wheeling coupling 13. Both free wheeling couplings 6 and 13 impart rotation to the transport cylinder in one direction only when driven by the mechanical reciprocating drives according to FIGS. 1–4 or by the second drive in the form of an auxiliary motor 11 with reduction gears, as it will be explained below with reference to FIGS. 5 and 6.

A stationary suction segment 16 is arranged in the interior of the rotary cylinder 8 and its suction orifice is in sliding contact with the inner surface of the cylindrical wall of the cylinder. The suction segment 16 is connected to a suction pipe 9 which is secured in the stand 5 and supports for rotation the tubular sleeve 82 of cylinder 8.

Figure 2:
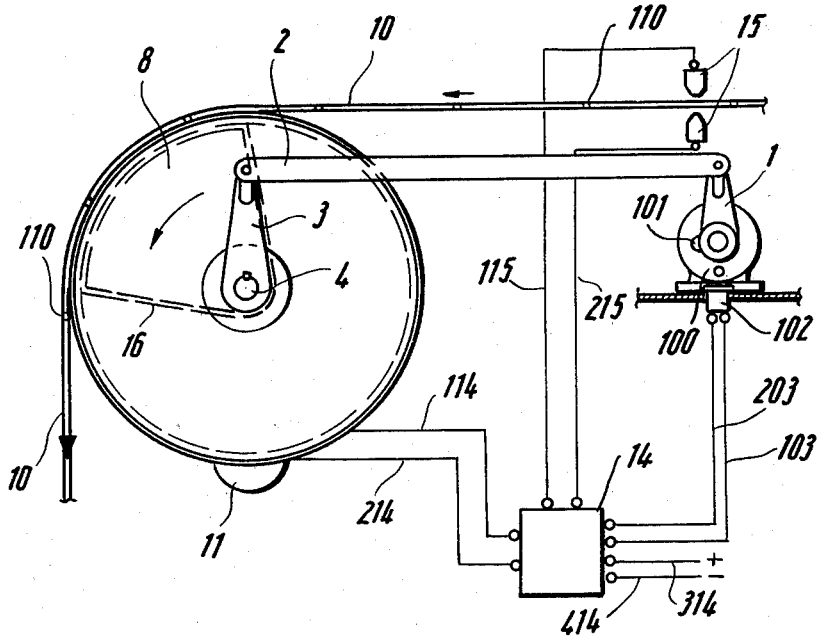
FIG. 2 is a side view of the device of FIG. 1.
Figure 3:
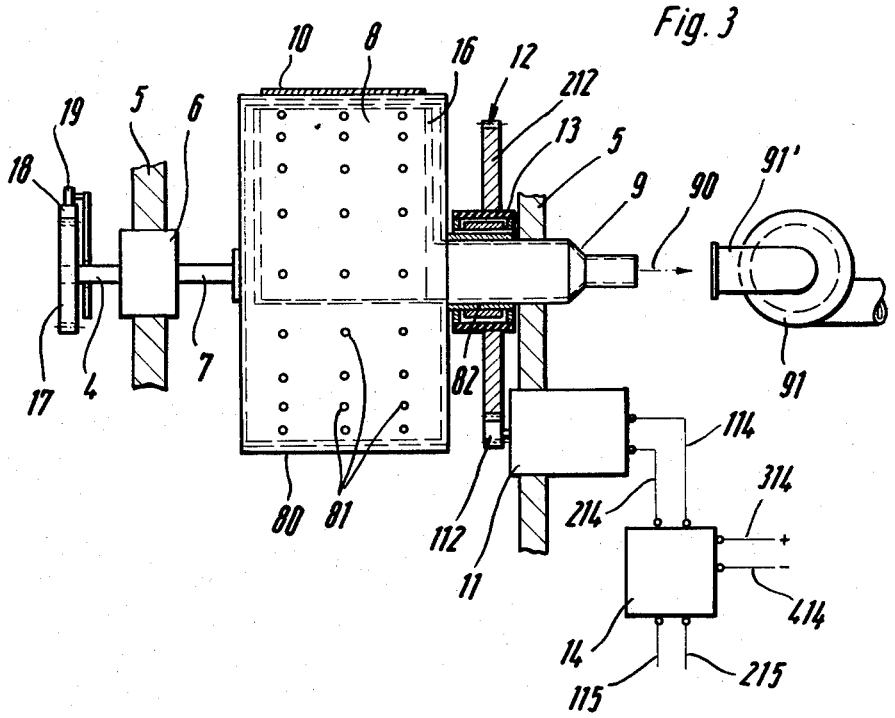
FIGS. 3 and 4 show, respectively, in a front view and in a side view, another embodiment of the device of this invention having a rack-and-pinion reciprocating drive.
Figure 4:
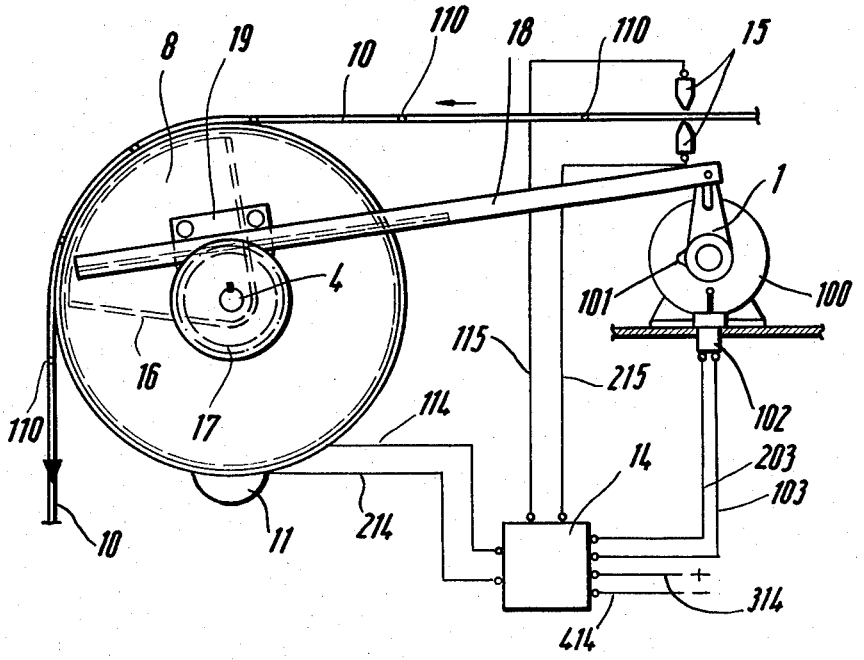

Cylinder 8 is intermittently driven either by a reciprocating crank drive as illustrated in FIGS. 1 and 2 or via a reciprocating rack-and-pinion drive according to FIGS. 3 and 4. Other types of the intermittent drive employing a main driving motor 111 or a combined motor 111' performing both the driving and correcting functions are illustrated in FIGS. 5–8.

In the embodiment of FIGS. 1 and 2 the driving motor 100 rotates a crank 1 which is linked via a coupling rod 2 to rocking arm 3 which exceeds in length the crank 1. The other end of rocking arm 3 is rigidly connected via shaft 4 to the free wheeling coupling 6 for unidirectionally driving the shaft 7 of cylinder 8. The free wheeling coupling 6 in this embodiment is constructed such as to drive shaft 7 in counterclockwise direction, whereas the coupling is disengaged when shaft 4 rotates in clockwise direction. The transported web 10 surrounds approximately a quadrant of the cylindrical wall of cylinder 8.

As it has been mentioned above, the suction segment 16 communicates with suction pipe 9 which in turn is connected by means of a hose or the like conduit schematically indicated by reference numeral 90, to the suction connector 91' of a suction pump 91. The suction pipe 9 which is fixedly mounted in the frame 5 serves as a bearing for the tubular sleeve 82 of cylinder 8. The tubular sleeve 82 acts as the inner race of the free wheeling coupling 13. The outer race of coupling 13 is integrally connected with transmission gear 12 which is in mesh with the drive pinion 112 of an auxiliary or correction driving motor 11. Similarly as the first-mentioned free wheeling coupling 6, coupling 13 drives the tubular sleeve 82 when gears 12 rotate counterclockwise. On the other hand, free wheeling coupling 13 permits free movement of the tubular sleeve 82 without moving the gear 12 when cylinder 8 is rotated in the counterclockwise direction by the main drive 100.

The auxiliary motor 11 is controlled by an electric control device 14 which is activated by a registering device 16 which detects register marks on the web. The register marks in this example are in the form of registering holes indicated by reference numeral 110 in FIG. 2. These register holes can be formed in web 10 by stamping for example, but other register marks such as printed lines or portions of the guide marks on the web can also be employed. The registering device 15 may include for example, selenium cells or similar sensors.

The operation of the device is as follows:

The continuously rotating crank 1 imparts via coupling rod 2 a reciprocating or back-and-forth movement to rocking arm 3 and this reciprocating movement is imparted to shaft 4. Dependent on the construction of the free wheeling coupling 6, the shaft 7 and thus transport cylinder 8 are rotated in one direction, in this example in the counterclockwise direction, about a predetermined angular displacement during each counterclockwise movement of arm 3 but is disengaged from the shaft 4 when arm 3 is moved in the clockwise direction. The other free wheeling coupling 13 is also constructed such as to permit free movement of cylinder 8 when the latter is driven by the main driving motor 1–0 while the reduction gears 12 stand still.

Suction pump 91 creates an underpressure in the suction pipe 9, and in the suction segment 16. Since the cylindrical wall is provided with perforations 81, the portion of web 10 which is in contact with the upper surface portion of cylinder 8 above the suction segment 16, is compressed by the resulting pressure difference against the frictional lining 80. Consequently, the web is carried along during each intermittent rotary step of cylinder 8 and thus intermittently advances by exactly predetermined intervals. As it has been mentioned above, the web can be a paper web, plastic foil, a nonwoven material but also fiber-containing fabrics.

It is more advantageous when the web is of a material which is not penetratable by air. Nonetheless, it is still possible to handle webs of materials which are permeable to air provided that the suction performance is correspondingly increased.

If web 10 is to be advanced by intervals which are not of equal length, the web is provided with marks extending in the feeding direction; these marks as it has been mentioned above, are register marks of different kinds which are scanned by the registering device 15.

The intervals defined by the register marks are always larger than the actual feeding intervals determined by the driving linkage of cylinder 8, that means by crank 1, coupling rod 2 and rocking arm 3. The difference between the marked and actual intervals is compensated by the second or correction drive which includes motor 11 and reduction gears 112 and 12. Motor 11 continues the forward rotation of cylinder 8 via gear 12 and the assigned free wheeling coupling 13 until registering device 15 detects the mark 110 pertaining to the desired web interval and generates a control signal which through electrical control means 14 deenergizes motor 11 and thus stops the rotation of cylinder 8. The registering device 15 is connected to control device 14 through electric conduits 115 and 215 and correction motor 11 is connected to the control device 14 via conductors 114 and 214.

The above-described additional rotation of cylinder 8 forming the second phase of the forward movement of the step in one intermittent interval takes place during the free wheeling movement of coupling 6 when rocking arm 3 with its shaft 4 is returned clockwise so that time for the main advancing step and for the printing process and the like, is saved. The reduction gear 12 can be in the form of a worm gear when a more precise adjustment is required.

To insure that the correction motor 11 is inoperative during the movement of the main drive, the shaft of auxiliary motor 100 is provided with cam 101 which cooperates with switch 102 through which motor 100 is electrically connected via conductors 103 and 203 to the control device 14. As soon as rocking arm 3 and thus cylinder 8 complete their forward angular displacement, the cylinder 8 comes first to a standstill since crank 1 which is shorter than arm 3 causes the latter to reverse its movement in clockwise direction. Cam 102 is positioned relative to switch 102 at such an angle that as soon as the rocking arm 3 reaches its forward limit the correction motor 11 is switched on and remains activated until the signal from the registering device 16 disconnects through control device 14 its power supply and thus terminates the second or corrective phase of the forward movement of the web.

FIGS. 3 and 4 show an embodiment of the transport device of this invention which essentially corresponds both in structure and in operation to the device of FIGS. 1 and 2. The main driving motor which may be provided with a reduction gear, drives again a crank 1 which moves back-and-forth, a coupling rod 2 in the form of a rack 18. The teeth of rack 18 engage pinion 17 on the shaft 4. A press member 19 keeps rack 18 in engagement with the pinion 17. The remaining part of the device are identical with those as described in the embodiment according to FIGS. 1 and 2.

The advantage of this rack-and-pinion reciprocating drive is in the fact that in the case when repeated feeding of the web is required, the register marks can be disregarded during the first feeding of the web since the correction motor 11 and gears 12 are ineffective. Another advantage is that larger feeding intervals can be adjusted.

The purely mechanical drive of the web via crank 1, coupling rod 2, arm 3 or the rack-and-pinion drives 17 and 18 can accurately adjust the angular displacement of the cylinder 8 and consequently the feeding intervals of the web 10 and enable also the adjustment of relatively large feeding intervals at a fast feeding rate.

If the desired feeding intervals become non-uniform due to the preceding printing, the auxiliary second drive serving for the corrective feeding movement, is activated in concert with the electric activation of the registering device 15.

As it has been described above, the major part of individual feeding intervals can be effected mechanically and the slight differences between the individual feeding intervals can be compensated by the aid of corresponding register marks 110 on the web which activate the additional correction drive.

This corrective advance of the web continues until registering device 15 detects the register mark on the web itself. As a result, the forward movement of the web in each interval of its advance can be adjusted with a very great precision even if the successive intervals of the web differ in length from one another. In other words, the first phase of feeding by purely mechanical driving means takes place during the first passage of the web through the printing machine whereas during the second or repeated passages of the web when it is necessary to adjust the changed length of the web to the printed images, the second or corrective drive is brought into action in response to the electronic scan of the register marks. As mentioned above, the purely mechanical phase in feeding the web is to be adjusted such as to produce a little shorter feeding interval. This adjustment is made by changing the linkage of coupling rod 2 to crank 1 or to rocking arm 3 by modifying the joint in the corresponding longitudinal slots. The electrical control device 14 is energized through conductors 314 and 414. This control device can be of any suitable type well known in the art.

Figure 5:
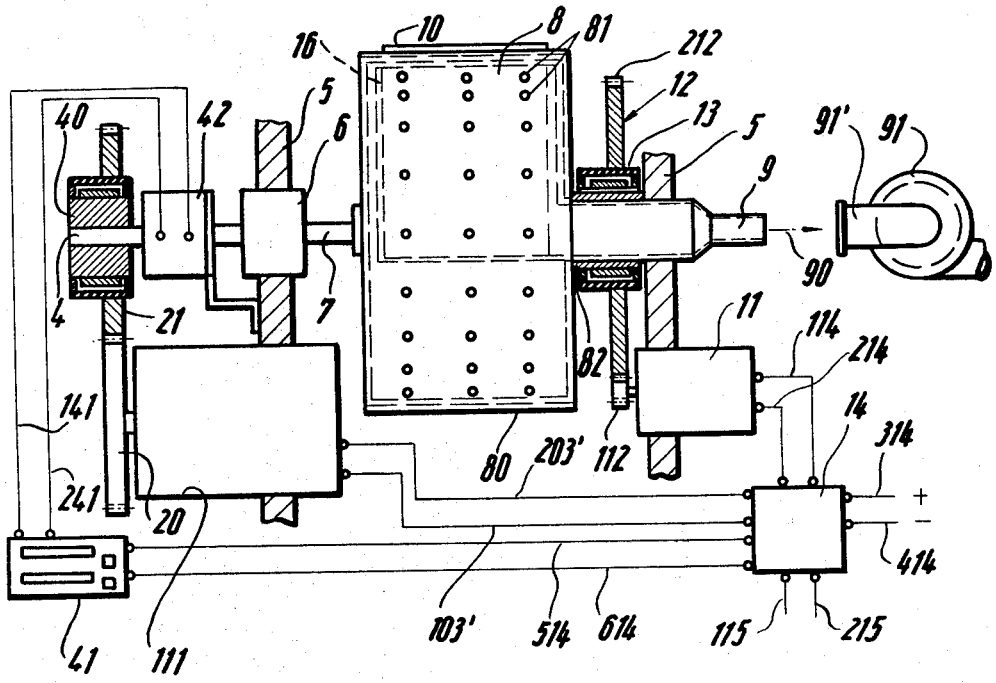
FIGS. 5 and 6 show, respectively, in a front and in a side view, an embodiment having driving means employing a main electromotor and a correction electromotor.
Figure 6:
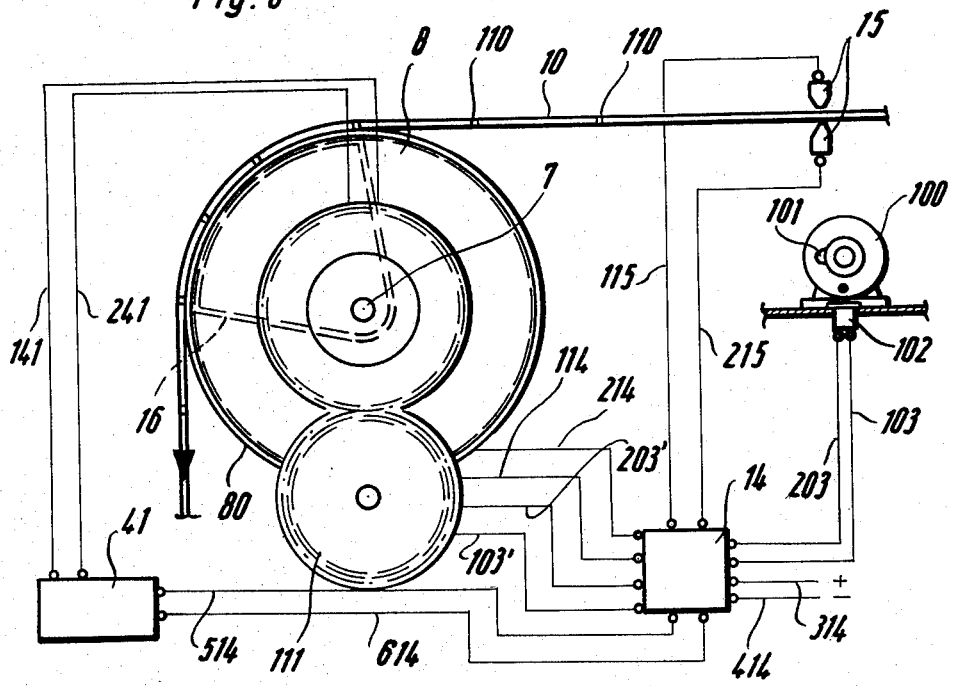

In the embodiment illustrated in FIGS. 5 and 6, the main drive is not a mechanical one. The main driving motor 111 is connected by conductors 103' and 203' to the control device 14 and drives via reduction gears 20 and 21 the outer race of an additional free wheeling coupling 40 the inner race of which is connected to the shaft 4 of the free wheeling coupling 6. The shaft 4 drives a pulse generator 42 which is connected by conductors 141 and 241 to pulse counter 41. The output of counter 41 is connected by conductors 514 and 614 to the electrical control device 14.

The signal from the pulse counter 41 controls the energization of the main driving motor 111 during the first feeding phase. In this embodiment, the main drive acts, therefore, as an intermittent drive without having a reciprocating movement. The correction motor 11 for the second phase of the advance of the web in one interval is connected similarly as in the preceding example by connectors 114 and 214 to control device 14 to take over the second corrective phase in each feeding interval. Motor 100 in this embodiment is employed for driving the printing machine. The crank driven linkage mechanism is dispensed with and only switch 102 activated by cam 101 on the shaft of motor 100 is used for generating impulses which control via conductors 103 and 203 the control device 14 to activate the transport device in response to the printing process in the printing machine. In a modification of this embodiment and also of the embodiment according to FIGS. 7 and 8 as it will be explained below, registering device 15 is connected via conductors 115 and 215 to the control device 14 which in this variation includes a clock pulse generator and is also electrically connected to the printing machine to directly transmit to the latter an electrical starting pulse. The main driving motor 111 is energized by the control device 14 via conductors 103' and 203'.

The operation of this embodiment is identical to that as described in connection with the mechanically driven transport cylinders. The main difference, however, is the provision of the counter 41 of the pulses generated in the pulse generator 42 in response to the rotation of the main driving electromotor 111. In this manner, the impulse generator 42 determines the angular displacement of the transport cylinder 8.

Figure 7:
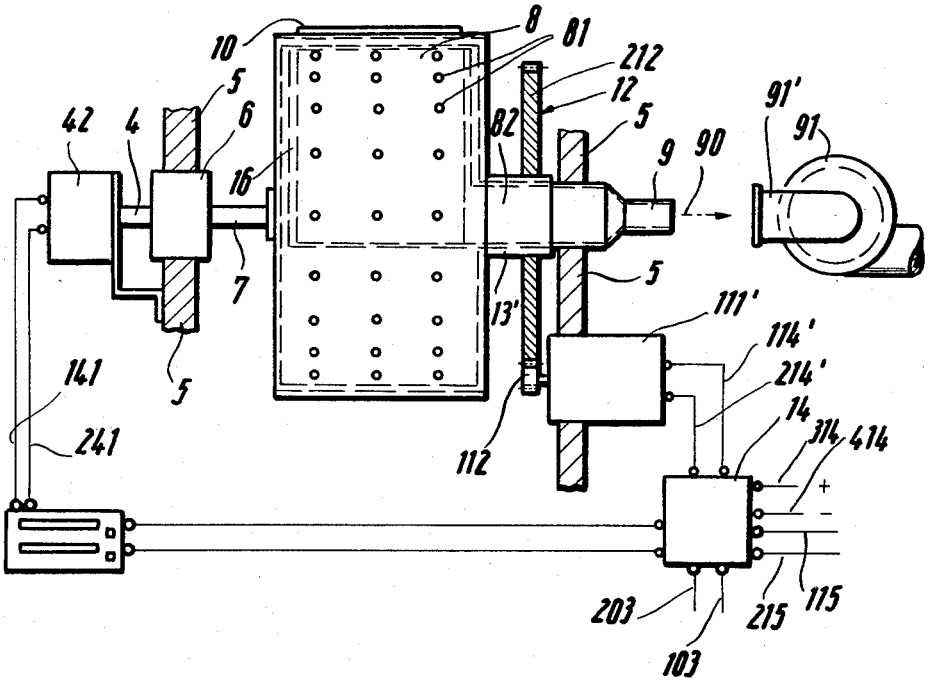
FIGS. 7 and 8 show in a front and a side view still another embodiment of this invention having a common driving and adjusting motor.
Figure 8:
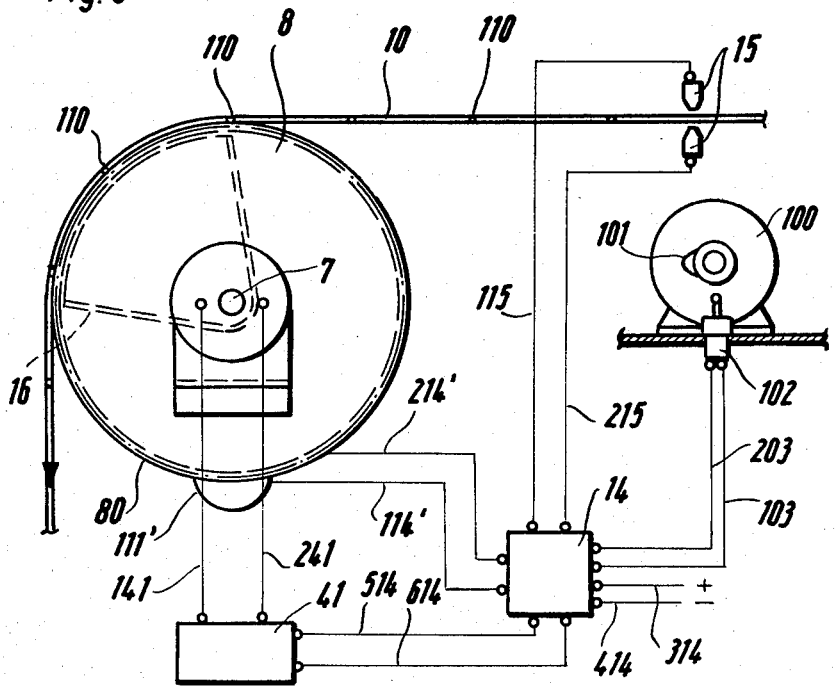

In the embodiment according to FIGS. 7 and 8, the overall construction of the transport device of this invention is still further simplified inasmuch as a single driving motor 111' is employed both for the main driving phase and for the correcting phase of the intermittent advance of the web. The motor 111' is connected via conductors 114' and 214' to the electrical control device 14. The motor 111' is a switchable electromotor capable of acting as the main drive and upon switching as a correction drive. In this embodiment it is no longer necessary to employ free wheeling couplings in the bearings 6' and 13' even if the bearing block 6' might be provided with a free wheeling coupling to act as arresting means to protect the cylinder 8 against reverse rotation. The essential feature of the embodiment according to FIGS. 5–8 is the provision of the digital devices 41 and 42 for controlling the control device 14 which is adapted for controlling the rotation of the main driving motor 111' so that the latter can be automatically switched over from the main driving mode of operation to the corrective mode of operation. In this manner, the driving motor 111 and the correction motor 11 are combined in a single motor 111' so that a particularly compact intermittently forwarding device will result.

It will be understood that each of the elements described above, or two or more together, may also find a useful application in other types of constructions differing from the types described above.

While the invention has been illustrated and described as embodied in an intermittent forwarding device, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A transport device for intermittently feeding a web, comprising a rotary hollow cylinder having a perforated cylindrical wall for supporting the web to be transported; a stationary suction member arranged in said cylinder opposite to the inner surface of a section of the cylindrical wall which is in contact with said web; and drive means for imparting an intermittent rotation to said cylinder and thus a predetermined forward movement to said web.

2. The device as defined in claim 1, further including control means for adjusting the rotational speed of said cylinder within the limits of one feeding interval.

3. A transport device for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web; control means for adjusting the rotational speed of said cylinder within the limits of one feeding interval, said drive means including a main drive for executing a major part of the advance of said web within the limits of one feeding interval and a corrective drive cooperating with said control means to compensate for variations in length of said web.

4. The device as defined in claim 3, wherein said main drive includes a main driving motor, a mechanical crank linkage for converting the rotary movement of said main driving motor into a reciprocating movement, and undirectional coupling means disposed between said rotary cylinder and said linkage to drive said cylinder in one direction but to disengage said cylinder in the opposite direction.

5. The device as defined in claim 3, wherein said correction drive includes a correction motor, reduction gears driven by said correction motor, a unidirectional coupling arranged between said rotary cylinder and said reduction gears to drive said cylinder in said one direction and to disengage said cylinder from said drive gear in the opposite direction, and said control means including a registering device for reading register marks on said web and to generate a stop signal for said correction motor when a register mark is detected.

6. The device as defined in claim 4, wherein said mechanical crank linkage includes a crank connected to the shaft of the main driving motor, a coupling rod and a rocking arm, said unidirectional coupling means including a free wheeling coupling having its outer race connected to said rocking arm and its inner race connected to the drive shaft of said rotary cylinder.

7. The device as defined in claim 4, wherein said mechanical crank linkage includes a crank connected to the shaft of said main driving motor, a coupling rod in the form of a rack and a pinion connected to said unidirectional coupling means and being in engagement with said rack.

8. The device as defined in claim 7, further comprising means for urging said rack against said pinion.

9. The device as defined in claim 5, wherein said additional unidirectional coupling means between the shaft of said rotary cylinder and said reduction gears is a free wheeling coupling.

10. A transport device for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web, said suction member including a suction segment having an orifice in contact with said portion of the inner surface of said cylindrical wall, a suction pipe communicating with said suction segment and projecting coaxially with the axis of rotation from said cylinder, and a suction pump connected to said suction pipe.

11. The device as defined in claim 4, wherein said control means includes means for activating said correction motor and electrical switching means for connecting and disconnecting said activating means from said motor in response to the output signal from said registering device.

12. A transport device for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web drive means for imparting an intermittent rotation to said cylinder and thus a predetermined forward movement to said web, the outer cylindrical surface of said rotary cylinder being provided with frictional lining having borings communicating with the perforations of said cylindrical wall.

13. The device as defined in claim 3, wherein said correction motor cooperates with a cam operated switch connected to said control means for activating said correction motor in response to the angular displacement in forward direction of said main driving means.

14. A transport device for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web, said drive means including a digitally controlled motor.

15. The device as defined in claim 14, further including control means for switching said motor into a main driving mode of operation and a corrective driving mode of operation.

16. The device as defined in claim 15, further including a pulse generator coupled to said rotary cylinder for generating pulses in response to the angular displacement of said cylinder, a pulse counter coupled to said control device for controlling said motor in response to the counted pulses.

17. The device as defined in claim 16, further including means for reading register marks on said web and for delivering an output signal to said control means for disconnecting said driving means, and further including a cam operated switch driven by an additional motor and connected to said control means for controlling the working cycle of the device.

18. The device as defined in claim 2 wherein said drive means includes a two-stage drive cooperating with said control means to impart to said cylinder within a feeding interval two successive rotational increments.

* * * * *

REEXAMINATION CERTIFICATE (236th)

United States Patent [19]

Klemm

[11] B1 4,249,688

[45] Certificate Issued Aug. 28, 1984

[54] DEVICE FOR INTERMITTENT FEEDING OF WEBS

[76] Inventor: Gerhard Klemm, Am Rehwinkel 37, 4800 Bielefeld 1, Fed. Rep. of Germany

Reexamination Request:
No. 90/000,119, Dec. 2, 1981

Reexamination Certificate for:

| | |
|---|---|
| Patent No.: | **4,249,688** |
| Issued: | **Feb. 10, 1981** |
| Appl. No.: | **21,819** |
| Filed: | **Mar. 19, 1979** |

[30] Foreign Application Priority Data

Mar. 20, 1978 [DE] Fed. Rep. of Germany ..... 2812099

[51] Int. Cl.[3] ..... B65H 17/65

[52] U.S. Cl. ..... 226/24; 226/30; 226/95

[58] Field of Search ..... 226/7, 24, 30, 31, 95, 226/97, 120, 122, 123; 101/225–228; 242/182, 206, 208–210

[56] References Cited

U.S. PATENT DOCUMENTS

| | | | |
|---|---|---|---|
| 3,837,552 | 9/1974 | Monahan et al. | 226/122 |
| 3,945,317 | 3/1976 | Brasa | 101/124 |
| 4,066,016 | 1/1978 | Tison | 101/228 |

FOREIGN PATENT DOCUMENTS

| | | |
|---|---|---|
| 737375 | 7/1943 | Fed. Rep. of Germany . |
| 1819848 | 7/1960 | Fed. Rep. of Germany . |
| 1920020 | 4/1965 | Fed. Rep. of Germany . |
| 1411774 | 12/1968 | Fed. Rep. of Germany . |
| 2720871 | 12/1977 | Fed. Rep. of Germany . |
| 2332153 | 2/1979 | Fed. Rep. of Germany . |

OTHER PUBLICATIONS

German Periodical: Allgemeine Papier-Rundschau 1955, Nr. 7, p. 310, "Das Webatron".

*Primary Examiner*—Leonard D. Christian

[57] ABSTRACT

The transport device for intermittently feeding a web into or from a printing machine, for example, includes a rotary hollow cylinder having a perforated cylindrical wall for supporting the web, a stationary suction segment arranged in the cylinder in contact with the portion of the inner cylindrical surface that is below the web, and a main drive adapted for imparting an intermittent rotation to the cylinder, and a correction drive coupled to electronic registration detector to impart an additional adjustment to the forward drive in one feeding interval.

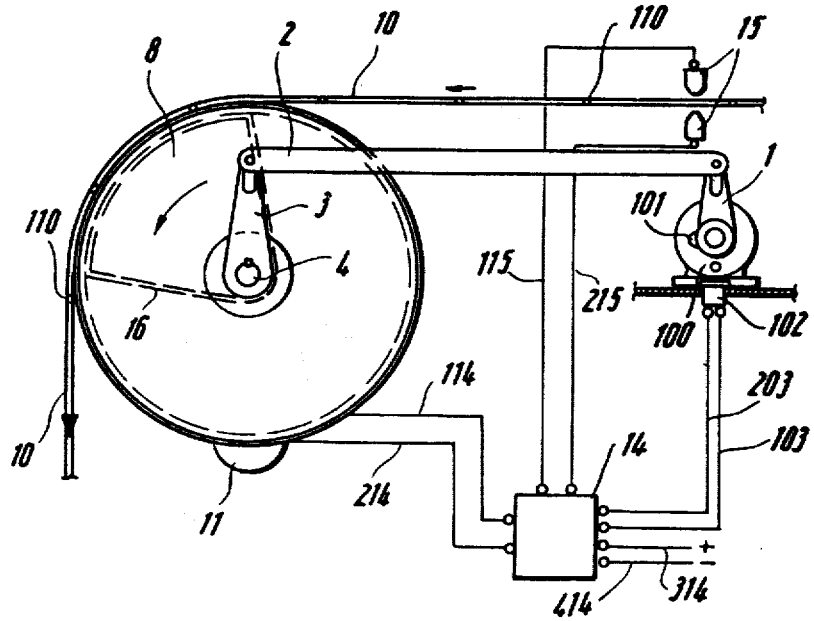

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2 and 14–17 are cancelled.

Claims 3, 10, 12 and 18 are determined to be patentable as amended.

Claims 4–9, 11 and 13, dependent on an amended claim, are determined to be patentable.

New claims 19–22 are added and determined to be patentable.

3. A transport device *as defined in claim 19, wherein* [for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web; control means for adjusting the rotational speed of said cylinder within the limits of one feeding interval,] said drive means [including] *includes* a main drive for executing a major part of the advance of said web within the limits of one feeding interval and a corrective drive cooperating with said control means to compensate for variations in length of said web.

10. A transport device *as defined in claim 19, wherein* [for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web,] said suction member [including] *includes* a suction segment having an orifice in contact with said [portion] *section* of the inner surface of said cylindrical wall, a suction pipe communicating with said suction segment and projecting coaxially with the axis of rotation from said cylinder, and a suction pump connected to said suction pipe.

12. A transport device *as defined in claim 19, wherein* [for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web drive means for imparting an intermittent rotation to said cylinder and thus a predetermined forward movement to said web,] the outer cylindrical surface of said rotary cylinder [being] *is* provided with frictional lining having borings communicating with the perforations of said cylindrical wall.

18. The device as defined in claim [2] *19* wherein said drive means includes a two-stage drive cooperating with said control means to impart to said cylinder within a feeding interval two successive rotational increments.

*19. A transport device for intermittently feeding a web, comprising a rotary hollow cylinder having a perforated cylindrical wall for supporting the web to be transported; a stationary suction member arranged in said cylinder opposite to the inner surface of a section of the cylindrical wall which is in contact with said web; drive means for imparting an intermittent rotation to said cylinder and thus a predetermined forward movement to said web; and control means for adjusting the rotational speed of said cylinder within the limits of one feeding interval.*

*20. A transport device for intermittently feeding a web, comprising a rotary hollow cylinder having a perforated cylindrical wall for supporting the web to be transported; a stationary suction member arranged in said cylinder in operative proximity to a portion of the cylindrical wall which is in contact with said web; drive means for imparting an intermittent rotation to said cylinder and thus a predetermined forward movement to said web, said drive means including a digitally controlled motor; control means for switching said motor into a main driving mode of operation and a corrective driving mode of operation; a pulse generator coupled to said rotary cylinder for generating pulses in response to the angular displacement of said cylinder; a pulse counter coupled to said control device for controlling said motor in response to the counted pulses; means for reading register marks on said web and for delivering an output signal to said control means for disconnecting said driving means; and a cam operated switch driven by an additional motor and connected to said control means for controlling the working cycle of the device.*

*21. A transport device for intermittently feeding a web, comprising a rotary hollow cylinder having a perforated cylindrical wall for supporting the web to be transported; a stationary suction member arranged in said cylinder opposite to the inner surface of a section of the cylindrical wall which is in contact with said web; control means for adjusting the rotational speed of said cylinder within the limits of one feeding interval; and drive means for imparting an intermittent rotation to said cylinder and thus a predetermined forward movement to said web, said drive means being arranged to execute a major part of the advance of said web within the limits of one feeding interval and to compensate for variations in length of said web, said drive means including a two-stage drive cooperating with said control means to impart to said cylinder within one feeding interval two successive rotational increments in one direction corresponding to the forward movement of said web.*

*22. A transport device for intermittently feeding a web, comprising a rotary hollow cylinder having a perforated cylindrical wall for supporting the web to be transported; a stationary suction member arranged in said cylinder opposite to the inner surface of a section of the cylindrical wall which is in contact with said web; control means for adjusting the rotational speed of said cylinder within the limits of one feeding interval; and drive means for imparting an intermittent rotation to said cylinder and thus a predetermined forward movement to said web, said drive means being arranged to execute a main driving phase and thereby a major part of the advance of said web within the limits of one feeding interval and to execute a corrective*

*phase and thereby to compensate for variations in length of said web, said drive means including as a single two-stage drive motor executing said main driving phase and said corrective phase and cooperating with said control means to*

*impart to said cylinder within one feeding interval two successive rotational increments in one direction corresponding to the forward movement of said web.*

* * * * *